US009145729B2

(12) United States Patent
Spransy

(10) Patent No.: US 9,145,729 B2
(45) Date of Patent: Sep. 29, 2015

(54) CLASSROOM BALLISTIC BARRIERS

(71) Applicant: DAW Technologies, LLC, Salt Lake City, UT (US)

(72) Inventor: Peter J. Spransy, Salt Lake City, UT (US)

(73) Assignee: DAW Technologies, LLC, Salt Lake City, UT (US)

( * ) Notice: Subject to any disclaimer, the term of this patent is extended or adjusted under 35 U.S.C. 154(b) by 0 days.

(21) Appl. No.: 14/164,061

(22) Filed: Jan. 24, 2014

(65) Prior Publication Data

US 2014/0208993 A1 Jul. 31, 2014

Related U.S. Application Data

(60) Provisional application No. 61/756,505, filed on Jan. 25, 2013.

(51) Int. Cl.

| | |
|---|---|
| ***E05B 55/00*** | (2006.01) |
| ***E05G 5/00*** | (2006.01) |
| ***E04H 9/06*** | (2006.01) |
| ***E05B 47/00*** | (2006.01) |
| ***E05B 65/08*** | (2006.01) |
| ***E05B 15/00*** | (2006.01) |
| ***E05B 65/46*** | (2006.01) |
| *E05D 15/06* | (2006.01) |

(52) U.S. Cl.

CPC *E05G 5/003* (2013.01); *E04H 9/06* (2013.01); *E05B 15/0093* (2013.01); *E05B 47/0012* (2013.01); *E05B 65/0888* (2013.01); *E05B 65/462* (2013.01); *E05B 2047/0068* (2013.01); *E05D 15/0621* (2013.01); *E05Y 2900/146* (2013.01)

(58) Field of Classification Search

CPC ..... E05G 5/003; E04H 9/06; E05B 47/0012; E05B 65/0888; E05B 15/0093; E05B 65/462

USPC ..... 49/449, 409, 425; 292/288, 289, 291, 292/297, 298, 338, 339, 259 R, DIG. 15, 292/DIG. 46; 70/14, 94; 16/82, 83

See application file for complete search history.

(56) References Cited

U.S. PATENT DOCUMENTS

| | | | | | |
|---|---|---|---|---|---|
| 2,643,420 | A * | 6/1953 | Schwartz | 49/458 |
| 3,471,189 | A * | 10/1969 | Ness | 292/266 |
| RE27,161 | E * | 8/1971 | Raymon | 49/449 |
| 4,135,376 | A * | 1/1979 | Evans et al. | 70/100 |
| 4,272,113 | A * | 6/1981 | Zins | 292/262 |
| 4,437,694 | A * | 3/1984 | Lillo | 292/235 |
| 4,461,502 | A * | 7/1984 | Burgess | 292/262 |
| 4,570,985 | A * | 2/1986 | Waldo et al. | 292/262 |
| 4,798,407 | A * | 1/1989 | Miller | 292/229 |
| 4,993,761 | A * | 2/1991 | Paskert | 292/288 |
| 5,141,272 | A * | 8/1992 | Veillette | 292/338 |
| 5,234,239 | A * | 8/1993 | Allenbaugh | 292/258 |
| 5,294,159 | A * | 3/1994 | Corrigan | 292/258 |
| 6,382,689 | B1 * | 5/2002 | Brown | 292/338 |

(Continued)

*Primary Examiner* — Jerry Redman
(74) *Attorney, Agent, or Firm* — Madson IP, P.C.

(57) ABSTRACT

A classroom barrier comprising a sliding panel or hinged panel designed to block a classroom door or window opening in certain emergency situations such as the presence of an armed assailant. The barrier is locked from the inside with no chance for it to be unlocked from the exterior. The classroom barrier is simple to operate, bullet resistant, and impenetrable for some predetermined length of time.

4 Claims, 16 Drawing Sheets

(56) References Cited

U.S. PATENT DOCUMENTS

| | | | | |
|---|---|---|---|---|
| 7,360,805 | B1 * | 4/2008 | Brown | 292/289 |
| 7,430,832 | B2 * | 10/2008 | Hung | 49/404 |
| 7,537,251 | B1 * | 5/2009 | Profita | 292/339 |
| 7,731,252 | B1 * | 6/2010 | Stewart | 292/259 R |
| 8,117,784 | B2 * | 2/2012 | Tarrega Illoret | 49/425 |
| 8,727,400 | B1 * | 5/2014 | Marchand | 292/272 |
| 8,752,870 | B2 * | 6/2014 | Wolf | 292/259 R |
| 2002/0144465 | A1 * | 10/2002 | Chang | 49/449 |
| 2007/0039244 | A1 * | 2/2007 | Polston | 49/449 |
| 2008/0018118 | A1 * | 1/2008 | Schultz | 292/259 R |

* cited by examiner

CLASSROOM BALLISTIC BARRIERS

This patent application claims the benefit of U.S. Provisional Patent Application Ser. No. 61/756,505 that was filed on Jan. 25, 2013, for an invention titled CLASSROOM BARRIER.

TECHNICAL FIELD

The present invention relates generally to ballistic barriers. More specifically, the present invention relates to a wall opening barrier for a doorway or windows in a classroom or the like.

BACKGROUND

In today's society there has arisen a need to provide protection for students against active shooters (gunmen) attacking defenseless victims on school campuses. There are many approaches being considered for such protection including but not limited to; more campus police, arming teachers, ballistic backpacks, etc. The present invention simply attempts to make Almost any classroom a "safe room". Creating "safe rooms" on campuses drastically reduces or eliminates the "opportunity" and permits trained professionals adequate time to respond to the threat. The barrier must be simple to operate; it must be bullet resistant and it must prevent breaching for some predetermined length of time, thus allowing time for local police/SWAT to respond.

SUMMARY OF THE INVENTION

The classroom ballistic barriers of the present disclosure are ingress barriers comprising at least one ballistic panel specifically designed to block entry through a classroom door or window or any other door or window where warding off an armed assailant is desirable.

The classroom ballistic barrier can be a sliding panel or hinged panel depending upon the configuration of the door opening or window opening to be blocked. The barrier must be locked from the inside with no chance for it to be unlocked from the exterior. It must be simple to operate, it must be bullet resistant, and lastly it must be impenetrable for some predetermined length of time.

The invention of the present disclosure is comprised of at least one sliding ballistic panel. Since classroom doors must swing outward (for exiting purposes), it is advisable that the classroom ballistic barrier be located on the inside of the door opening or window opening. Having the barrier on the inside of the door opening has several advantages. They are:

The door does not need to be closed prior to the barrier being shut.

The barrier mechanisms, frame, track, etc. are shielded by the wall and jamb of the doorway.

The barrier locking mechanism is shielded by the wall and jamb of the doorway.

The exposed portion of the barrier (the exterior) is completely smooth so there is nothing to pry on to gain entry.

Because the barrier is completely smooth from the exterior there will be nothing to suggest a vulnerability to the barrier from the assailant's point of view.

Because the barrier is located inside the door opening (for someone looking down a long hallway) it will not be immediately obvious which rooms are the "safe rooms."

The invention of the present disclosure automatically locks when the barrier is slid into position and can only be unlocked from the inside. A bar is connected to the sliding barrier so when the panel is slid across the door opening, the locking bar falls, under the force of gravity, into locking position.

In some embodiments, the locking bar may be spring-loaded to urge the locking bar to move into the locking position as the barrier is slid into position. In some embodiments, an urging plate is located across the storage side channel to ensure the locking bar begins to fall as the barrier is slid into position.

In some embodiments, the locking bar is painted or made of a material that is easily visible, such as optic orange, so it is obvious from visual observation that it is or is not properly positioned to lock the barrier. A resting stop is located at the bottom of the channel or within the bottom channel for the locking bar to rest against assuring that it is visible when in the "locked" position. The locking bar must be lifted up from inside the room to open the barrier.

The present invention has anticipated the need for a retention plate with and an angle flange that engages the bottom track so the barrier panel cannot be lifted from sliding engagement with the bottom track to gain entry. The barrier panel height is sized only slightly less than the dimension between the top track and bottom track so the panel cannot be lifted to gain entry or permit a gun barrel to be projected between the barrier panel and the floor.

It has been considered that this could have application for almost any door opening and almost any installation where a deranged person might choose to attack defenseless individuals.

The barrier panel is comprised of ballistic nonflammable fiberglass making the panels suitable for use in school corridors. The ballistic fiberglass has multiple layers of woven fiberglass making them incredibly difficult to cut through even when using carbide cutting tools. In fact, they are cut at the factory using a sophisticated water-jet. This feature makes them highly suitable for preventing breaching.

The barrier panel could be installed so that in the open position it is already past the door frame to ensure no interference with the door frame when closing.

A handle could be mounted on the barrier panel to facilitate closing.

The classroom barrier can be disguised as a simple bulletin board for everyday use so as not to unduly alarm young students or inform would be assailants.

When closed, the barrier panel is nested in a channel on at least three sides.

It has been considered that many different materials could be utilized in place of the ballistic fiberglass depending upon the threat and response time of local law enforcement. Such materials are known to those of skill in the art.

BRIEF DESCRIPTION OF THE DRAWINGS

Exemplary embodiments of the invention will become more fully apparent from the following description and appended claims, taken in conjunction with the accompanying drawings. Understanding that these drawings depict only exemplary embodiments and are, therefore, not to be considered limiting of the invention's scope, the exemplary embodiments of the invention will be described with additional specificity and detail through use of the accompanying drawings in which:

FIG. 1A is a perspective view showing an open doorway with the barrier panel in its stored position nested between an upper channel and a lower channel, and also showing a handle on the ballistic barrier panel. FIG. 1B is a perspective view of an open doorway with the ballistic barrier panel slid partway over the doorway, and showing the locking bar falling towards its locking position. As shown, the locking bar is a contrasting color to assist in its observation visually. FIG. 1C is a perspective view of the ballistic barrier panel blocking the open doorway and nesting into the side panel so that the locking bar is in its locking position and the ballistic barrier panel is nests in channels on three sides.

FIG. 3A is a perspective sectional view showing the ballistic barrier panel nested in the upper and lower channels when the ballistic barrier panel is in its storage position, leaving the doorway open. FIG. 3B is perspective sectional view showing the ballistic barrier panel nested in the upper and lower channels when the ballistic barrier panel has been moved to partially block the open doorway. FIG. 3C is perspective sectional view showing the ballistic barrier nested three ways in the side, upper, and lower channels (note that a portion of the ballistic barrier panel remains in the lower channel) when the ballistic barrier panel is in its fully deployed position, blocking the open doorway.

FIG. 4A is an elevational perspective view of the ballistic barrier panel nested in the lower channel when the ballistic barrier panel is in its storage position, leaving the doorway open. FIG. 4B is an elevational perspective view showing the ballistic barrier panel nested in the lower channel when the ballistic barrier panel has been moved to partially block the open doorway and also showing the locking bar moving towards its locking position.

FIG. 8A is an elevation of four ballistic barrier panels wherein each ballistic barrier panel is in its storage position, leaving the window opening open. FIG. 8B is an elevation view showing a first ballistic barrier panel moved to partially block the window opening and a first locking bar moving towards its locking position. FIG. 8C is an elevation view showing the first ballistic barrier panel overlapping a second ballistic barrier panel and in position to capture the second ballistic barrier panel for tandem movement and blocking more of the window opening. FIG. 8D is an elevation view showing the first ballistic barrier panel overlapping and capturing the second ballistic barrier for tandem movement to further block the window opening. FIG. 8E is an elevation view showing the first ballistic barrier panel moving the second ballistic barrier to further block the window opening, the first locking bar trails the first ballistic barrier panel. FIG. 8F is an elevation view showing the first ballistic barrier panel and the second ballistic barrier panel fully extended to further block the window opening, the trailing first locking bar is disposed in its locking position. FIG. 8G is an elevation view showing a third ballistic barrier panel moved to partially block the window opening and a second locking bar moving towards its locking position. FIG. 8H is an elevation view showing the third ballistic barrier panel overlapping a fourth ballistic barrier panel and in position to capture the fourth ballistic barrier panel for tandem movement and blocking more of the window opening. FIG. 8I is an elevation view showing the third ballistic barrier panel overlapping and capturing the fourth ballistic barrier for tandem movement to further block the window opening. FIG. 8J is an elevation view showing the third ballistic barrier panel moving the fourth ballistic barrier panel to further block the window opening, the second locking bar trails the third ballistic barrier panel. FIG. 8K is an elevation view showing the third ballistic barrier panel and the fourth ballistic barrier panel fully extended to fully block the window opening, the trailing second locking bar is disposed in its locking position.

DETAILED DESCRIPTION

Exemplary embodiments of the present invention will be best understood by reference to the drawings, wherein like parts are designated by like numerals throughout. It will be readily understood that the components of the present invention, as generally described and illustrated in the Figures herein, could be arranged and designed in a wide variety of different configurations. Thus, the following more detailed description of exemplary embodiments of the apparatus, system, and methods of the present invention, as represented in FIGS. 1A through 18, is not intended to limit the scope of the invention, as claimed, but is merely representative of exemplary embodiments of the invention.

The phrases "connected to," "coupled to" and "in communication with" refer to any form of interaction between two or more entities, including mechanical, electrical, magnetic, electromagnetic, fluid, and thermal interaction. Two components may be coupled to each other even though they are not in direct contact with each other. The term "abutting" refers to items that are in direct physical contact with each other, although the items may not necessarily be attached together.

The word "exemplary" is used herein to mean "serving as an example, instance, or illustration." Any embodiment described herein as "exemplary" is not necessarily to be construed as preferred or advantageous over other embodiments. While the various aspects of the embodiments are presented in drawings, the drawings are not necessarily drawn to scale unless specifically indicated.

The classroom ballistic barriers of the present disclosure are ingress barriers comprising at least one ballistic panel specifically designed to block entry through a classroom door or window or any other door or window where warding off an armed assailant is desirable.

Figure 1A:
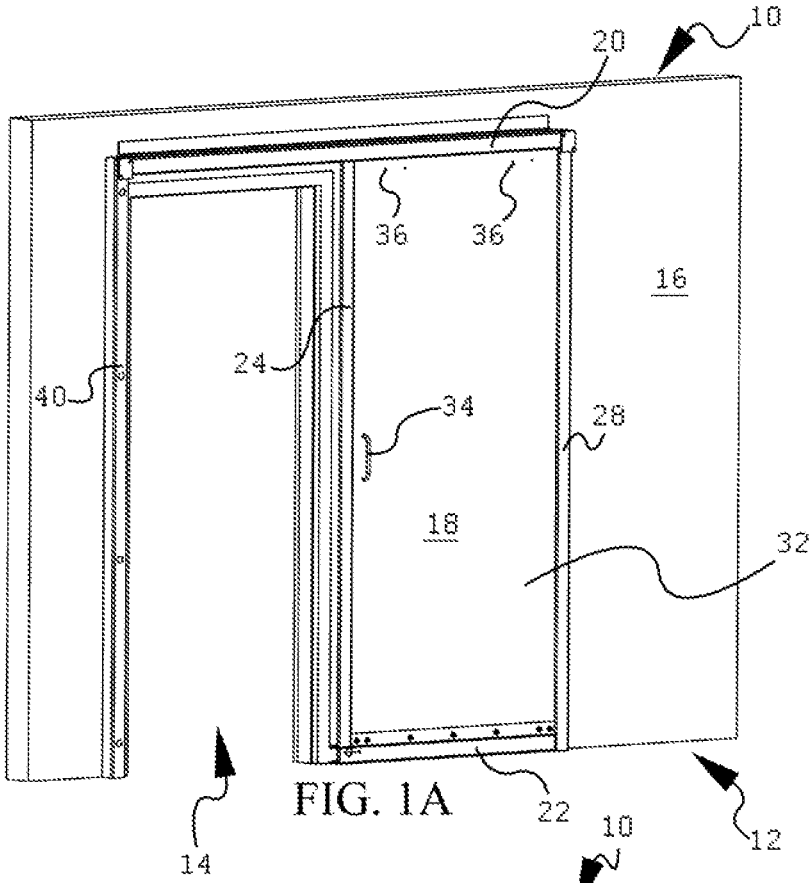
FIGS. 1A-1C illustrate a series of perspective views from inside a room showing an exemplary ballistic barrier panel transitioning from a stored position to a fully deployed position.
Figure 1B:
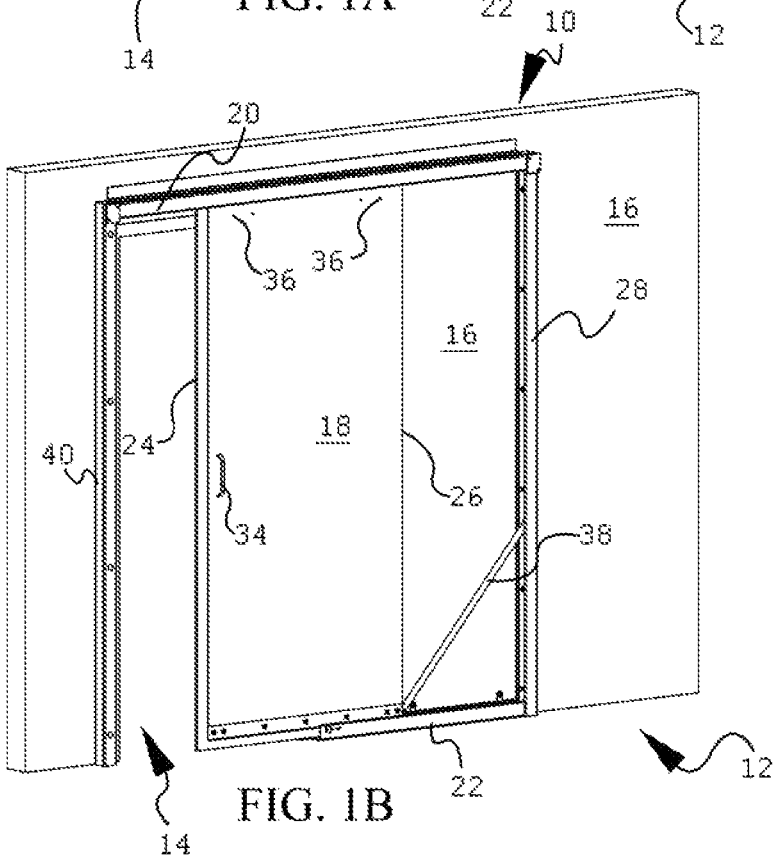
Figure 1C:
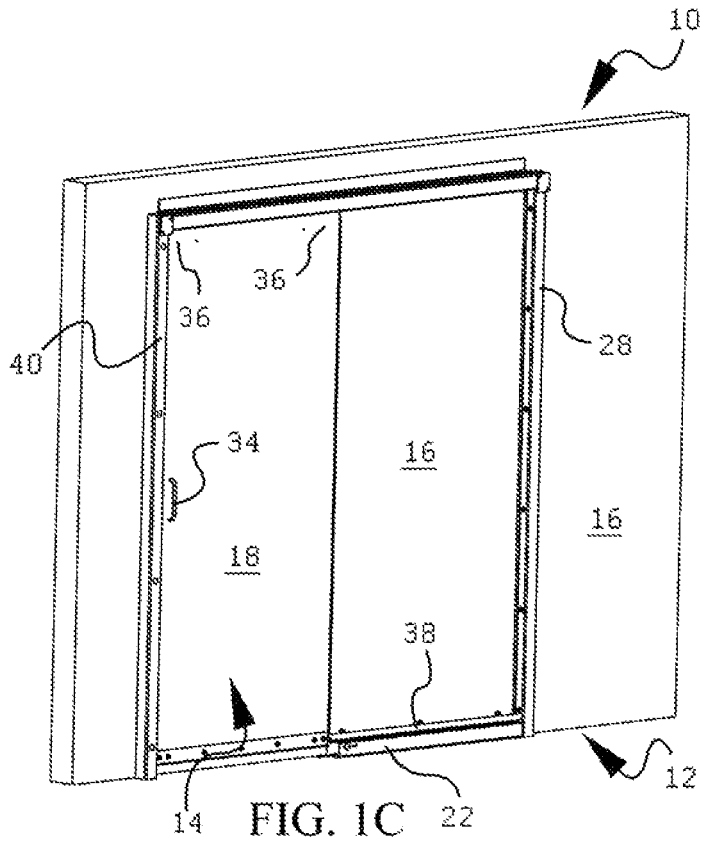

Turning to FIGS. 1A-1C, a series of perspective views of an exemplary ballistic barrier (generally designated 10) as viewed from inside a room 12 with a doorway 14 in an adjacent wall 16 is provided to show a ballistic barrier panel 18 as it transitions from a stored position to a fully deployed position. FIG. 1A shows an open doorway 14 with the ballistic barrier panel 18 in its stored position nested between an upper channel 20 and a lower channel 22. The ballistic barrier panel 18 has a leading edge 24 and a trailing edge 26 (shown in FIGS. 1B and 1C). In FIG. 1A, the trailing edge 26 in nested within or abuts against a storage side channel 28. Each ballistic barrier panel 18 has a threat side 30 (shown in FIG. 2) and a non-threat side 32. The threat side 30 is the side a would-be assailant may encounter, and in the depicted instance is the side facing away from the interior of the room 10. The non-threat side 32 faces into the room 10 and may be disguised as a simple bulletin board for everyday use so not to unduly alarm young students or inform would be assailants. Although a bulletin board, cork board, or some other classroom wall covering (not shown) can be applied to the non-threat side 32, it has been omitted from FIG. 1A so not to obscure the components of the ballistic barrier panel 18.

For ease in moving the ballistic barrier panel 18, a handle 34 is provided. To provide easy sliding movement, the ballistic barrier panel 18 is suspended from the upper channel 20 by heavy-duty suspension rollers 36 (partially obscured, see also FIG. 14) and the top edge and bottom edge of the ballistic barrier panel 18 nest within the upper channel 20 and the lower channel 22, respectively.

The ballistic barrier panel 18 is depicted as the same in each figure, differing only in its position with respect to the adjacent wall 16. FIG. 1B shows the ballistic barrier panel 18 drawn part way across the doorway 14, exposing the trailing edge 26 and a locking bar 38. The locking bar 38 is pivotally connected to the lower portion of the trailing edge 26 of the ballistic barrier panel 18. As the ballistic barrier panel 18 is slidably moved towards closing the doorway 14, the locking bar 38 drops, under the force of gravity, from a substantially vertical storage position (depicted in FIG. 1A) through an angled disposition (depicted in FIG. 1B) towards as substantially horizontal locking position (depicted in FIG. 1C).

In FIG. 1C, the ballistic barrier panel 18 is shown blocking the open doorway 14 and nesting into a side panel 40 so that the locking bar 38 is in its locking position and the ballistic barrier panel 18 nests in channels on three sides, the upper channel 20, the lower channel 22, and the side channel 40. Because the side channel 40 is offset from the doorway 14 opening, there is no apparent weakness on the threat side 30 when an assailant encounters the ballistic barrier 10. Also, once fully deployed, the ballistic barrier panel 18 cannot be moved until the locking bar 38 is lifted by someone inside the room 12 to release the ballistic barrier panel 18 so that it can be retracted.

Figure 2:
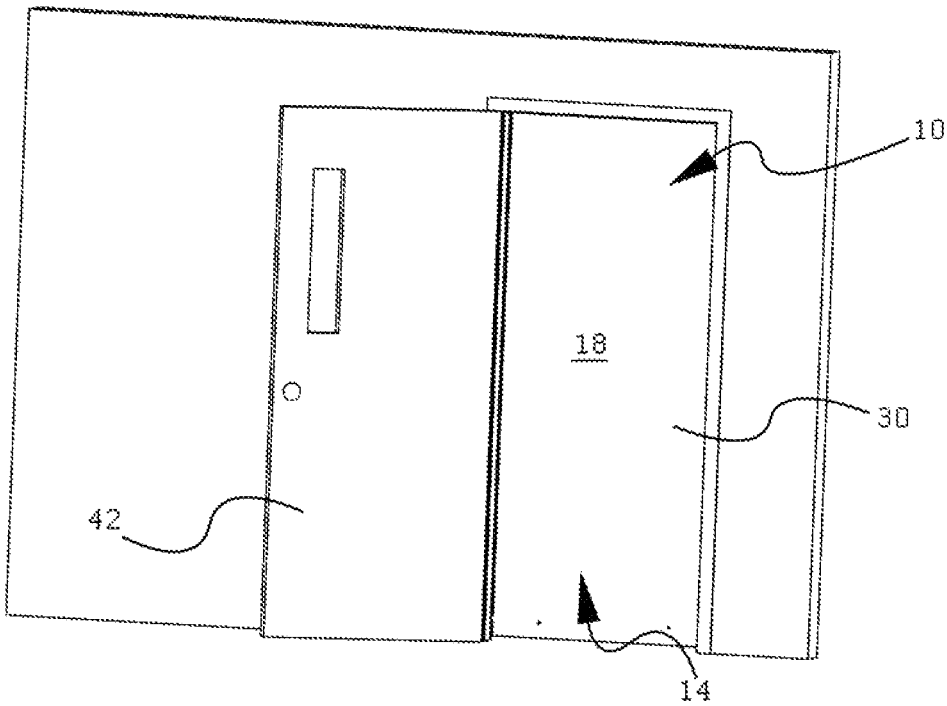
FIG. 2 is a perspective view of the open doorway from outside the room, showing the ballistic barrier panel completely blocking the doorway from physical or ballistic intrusion.

As shown in FIG. 2, there is no indication that the doorway 14 may be blocked by the ballistic barrier 10 that is visible in the hallway. Further, if the ballistic barrier 10 is deployed while the door 42 is closed, an assailant looking down a long hallway cannot determine which classrooms are equipped with a ballistic barrier 10 system.

Figure 3A:
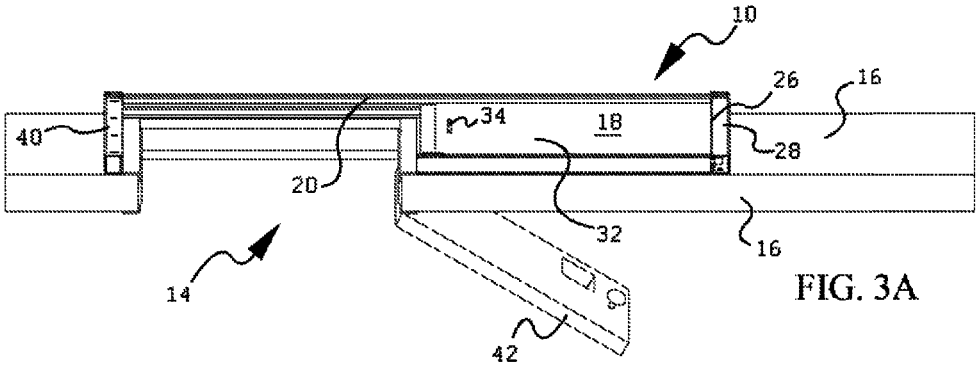
FIGS. 3A-3C illustrate a series of perspective sectional views looking upward from a section taken at floor level.
Figure 3B:
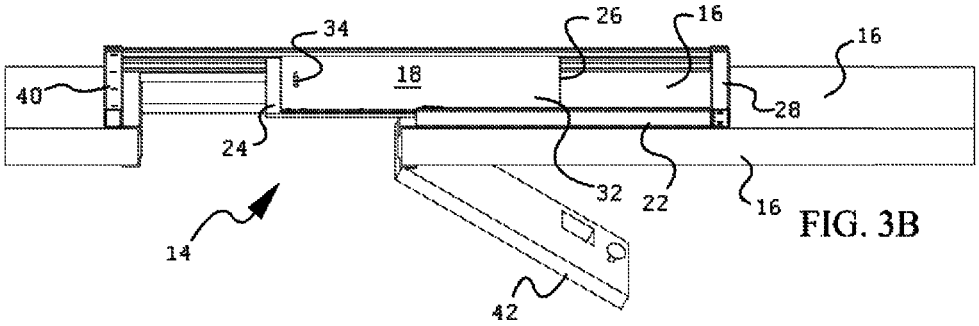
Figure 3C:
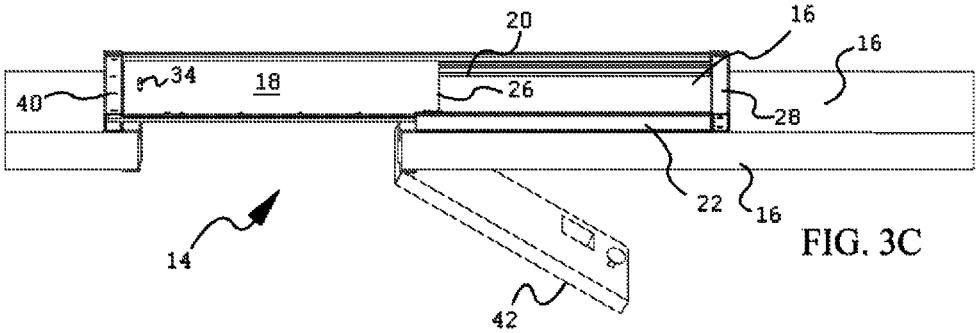

FIGS. 3A-3C illustrate a series of perspective sectional views of the ballistic barrier 10 looking upward from a section taken at floor level. FIG. 3A shows the ballistic barrier panel 18 nested in the upper and lower channels 20, 22 when the ballistic barrier panel 18 is in its storage position, leaving the doorway 14 open. FIG. 3B shows the ballistic barrier panel 18 nested in the upper and lower channels 20, 22 when the ballistic barrier panel 18 has been moved to partially block the open doorway 14. FIG. 3C shows the ballistic barrier panel 18 nested three ways in the side, upper, and lower channels 40, 20, 22 when the ballistic barrier panel 18 is in its fully deployed position, blocking the open doorway 14. Although the lower channel 22 does not extend across the threshold of the open doorway 14, a portion of the ballistic barrier panel 18 proximate the trailing edge 26 remains in the lower channel 22 so that the ballistic barrier 10 cannot be retracted from outside the room 12.

Figure 4A:
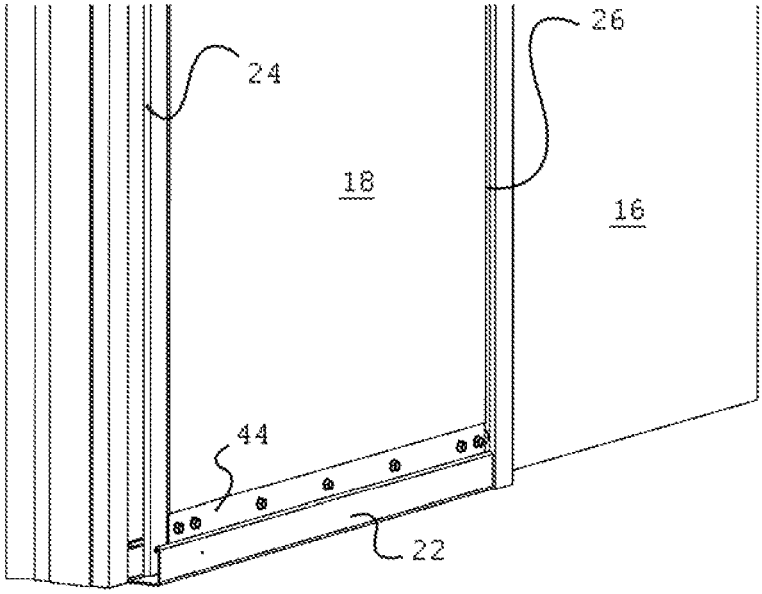
FIGS. 4A-4B illustrate elevation perspective views showing the exemplary ballistic barrier panel transitioning from a stored position to a fully deployed position.
Figure 4B:
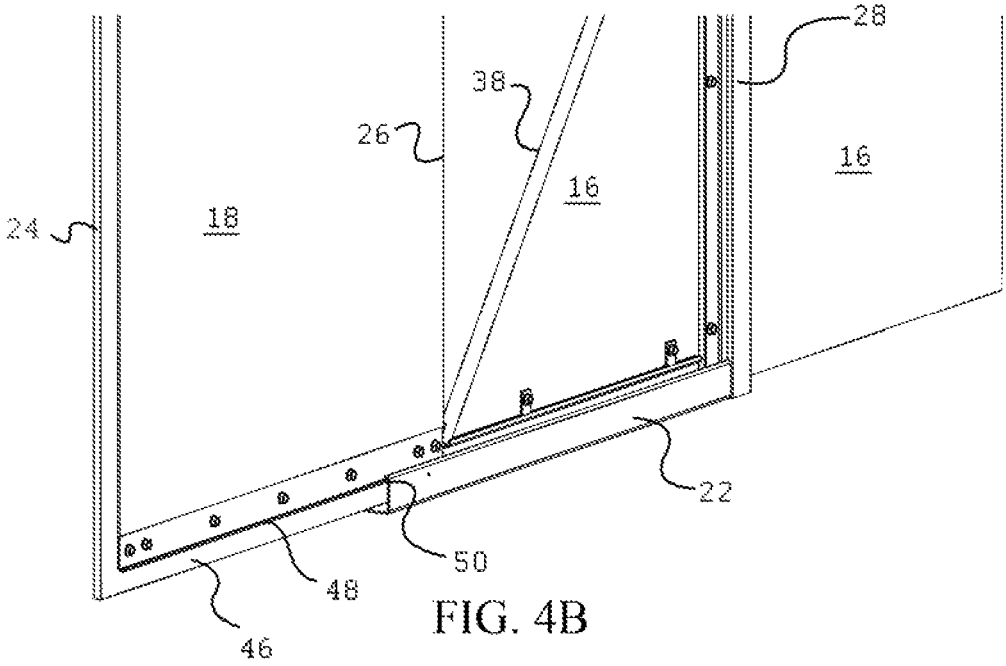

FIGS. 4A-4B are elevation perspective views showing the slidable engagement of the lower portion of the ballistic barrier panel 18 as nested in the lower channel 22. FIG. 4A shows a retention plate 44 disposed proximate the bottom edge 46 of the ballistic barrier panel 18. As shown in FIG. 4B, the retention plate 44 has an angled flange 48 that travels beneath a curled flange 50 that runs along the length of the lower channel 22. The angled flange 48 will engage the curled flange 50 to inhibit the ballistic barrier panel 18 from being lifted from its nested relationship with the lower channel 22.

Figure 5:
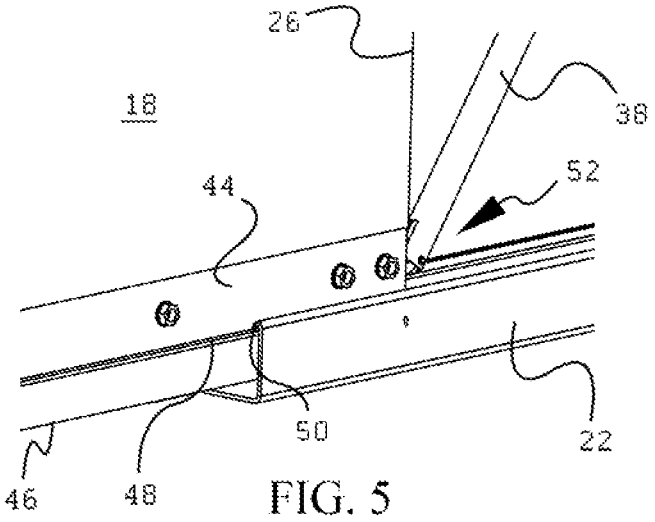
FIG. 5 is a cutaway perspective view of the lower portion of the ballistic barrier panel showing the pivotal connection for the locking bar that enables the locking bar to fall, under the force of gravity, as the ballistic barrier panel is moved slidably from its storage position towards the fully deployed position.

FIG. 5 is a cutaway perspective view of the lower portion of the ballistic barrier panel 18 proximate the trailing edge 26 and showing the pivotal connection 52 of the locking bar 38 that enables to the locking bar 38 to fall, under the force of gravity, as the ballistic barrier panel 18 is moved slidably from its storage position towards the fully deployed position. FIG. 5 also shows that the angled flange 48 of the retention plate 44 travels beneath the curled flange 50 of the lower channel 22 to inhibit the ballistic barrier panel 18 from being lifted from its nested relationship with the lower channel 22.

Figure 6:
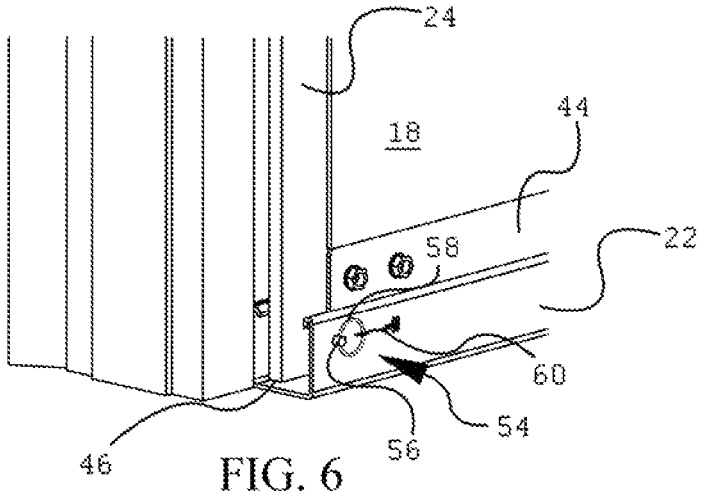
FIG. 6 is a cutaway perspective view of an alternative exemplary embodiment showing a tethered lock pin securing the ballistic barrier panel in the stored position.

FIG. 6 illustrates an alternative exemplary embodiment of the ballistic barrier 10 showing a tethered lock pin 54 securing the ballistic barrier panel 18 in the stored position. The tethered lock pin 54 must be released by pulling the lock pin 56 out of its locked position either by pulling on the lock ring 58 or the tether 60. The tethered lock pin 54 immobilizes the ballistic barrier panel 18 preventing a student from inadvertently moving the ballistic barrier panel 18 by pulling on the handle 34. This is an added safety feature to prevent curious younger students who may not understand how to open the ballistic barrier 10 if inadvertently closed while an adult is not in the room 12 from being trapped within the room 12.

Figure 7:
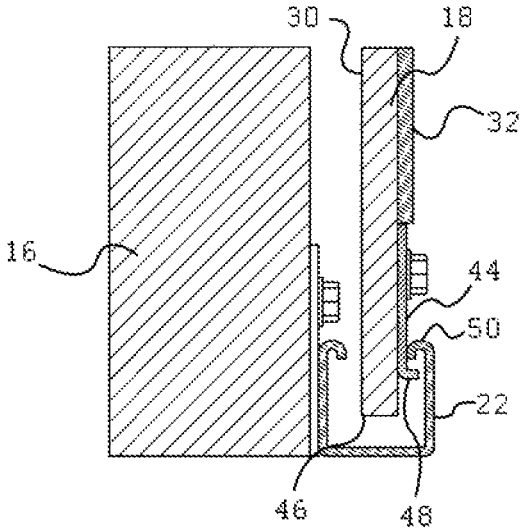
FIG. 7 is vertical section view of the ballistic barrier panel disposed within the bottom channel showing the retention plate with an angled flange for retaining the ballistic barrier panel within the bottom channel.

FIG. 7 is vertical section view showing yet another perspective of the ballistic barrier panel 18 disposed within the bottom channel 22 showing the retention plate 44 with the angled flange 48 for retaining the ballistic barrier panel 18 within the bottom channel 22.

FIGS. 8A-8K illustrate a series of step-by-step movements for transitioning an exemplary four-panel ballistic barrier 10 from stored positions to a fully deployed position blocking a large window opening 62. Of course, it should be understood that a single panel or double panel embodiment of the ballistic barrier 10 can be used to block smaller window openings 62 from undesired ballistic intrusion. Also, a person of ordinary skill in the art of ballistic shielding, armed with the disclosure of this application, would understand how to modify the embodiments disclosed herein to block other types of window openings frequently found in schools, other window openings such as a sidelight window, a transom window, and a clear-story window.

Figure 8A:
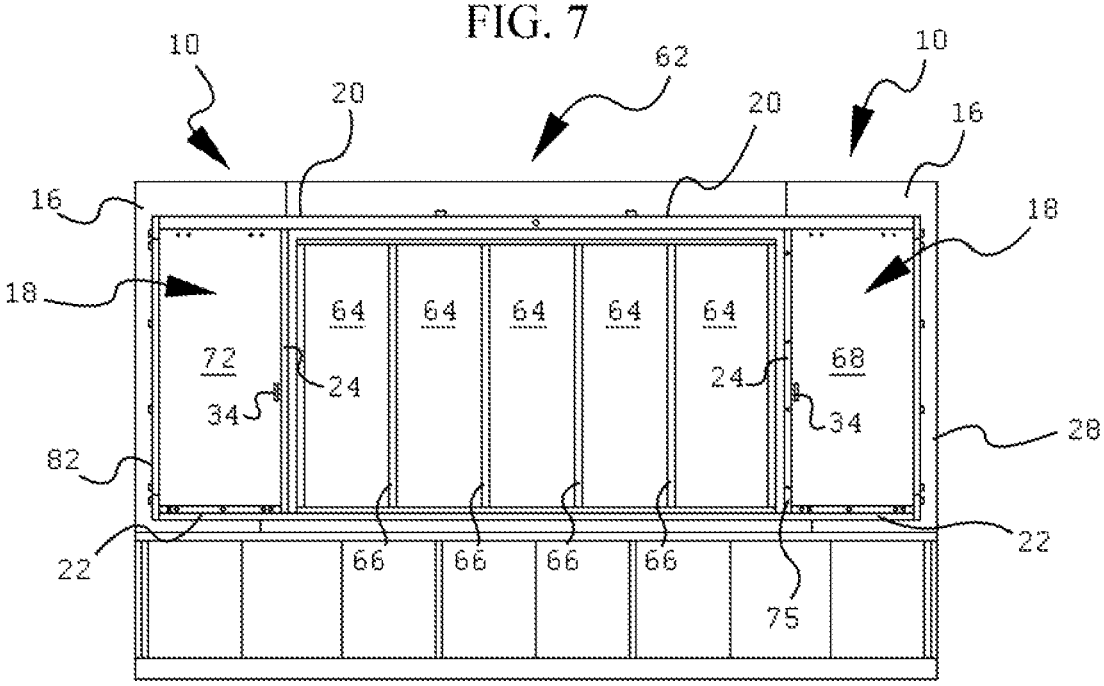
FIGS. 8A-8K illustrate a series of inside a room elevation views showing an exemplary four-panel ballistic barrier transitioning from stored positions to a fully deployed position blocking a large window opening.

FIG. 8A is an elevation of four ballistic barrier panels 18 wherein each ballistic barrier panel is in its storage position, leaving the window opening 62 open. By way of example, the window opening 62 comprises five window panes 64 separated by four mullions 66. The four ballistic barrier panels 18 are stacked two deep in an overlapping fashion on each side of the window opening 62. On one side of the window opening 62, a first ballistic barrier panel 68 is visible from inside the room 12, while a second ballistic barrier panel 70 is obscured from view. On the other side of the window opening 62, a third ballistic barrier panel 72 is visible from inside the room 12, while a fourth ballistic barrier panel 74 is obscured from view. As depicted, first ballistic barrier panel 68 has an astragal 75 secured to its leading edge 24; however, it should be understood that alternatively the astragal 75 could be secured to the leading edge 24 of third ballistic barrier panel 72. The astragal 75 will be described with reference to FIG. 12 hereinafter.

In the storage position, the first ballistic barrier panel 68 is nested in slidable engagement within the upper channel 20 and the lower channel 22, while the second ballistic barrier panel 70 is nested in slidable engagement within a second upper channel 76 and a second lower channel 78. Additionally, the ballistic barrier 10 may comprise the storage side channel 28 and a second storage side channel 80 wherein the first ballistic barrier panel 68 rests against the storage side channel 28 and the second ballistic barrier panel 70 rests against the second storage side channel 80. Likewise, on the other side of the window opening 62, the third ballistic barrier panel 72 is nested in slidable engagement within the upper channel 20 and the lower channel 22. It should be understood that the lower channel 22 may extend the full length of the window opening 62 because unlike doorway thresholds, windows are not routinely used for ingress and egress from a room 12. Additionally, the ballistic barrier 10 may comprise a third storage side channel 82 and a fourth storage side channel 84 wherein the third ballistic barrier panel 72 rests against the third storage side channel 82 and the fourth ballistic barrier panel 74 rests against the fourth storage side channel 84.

Figure 8B:
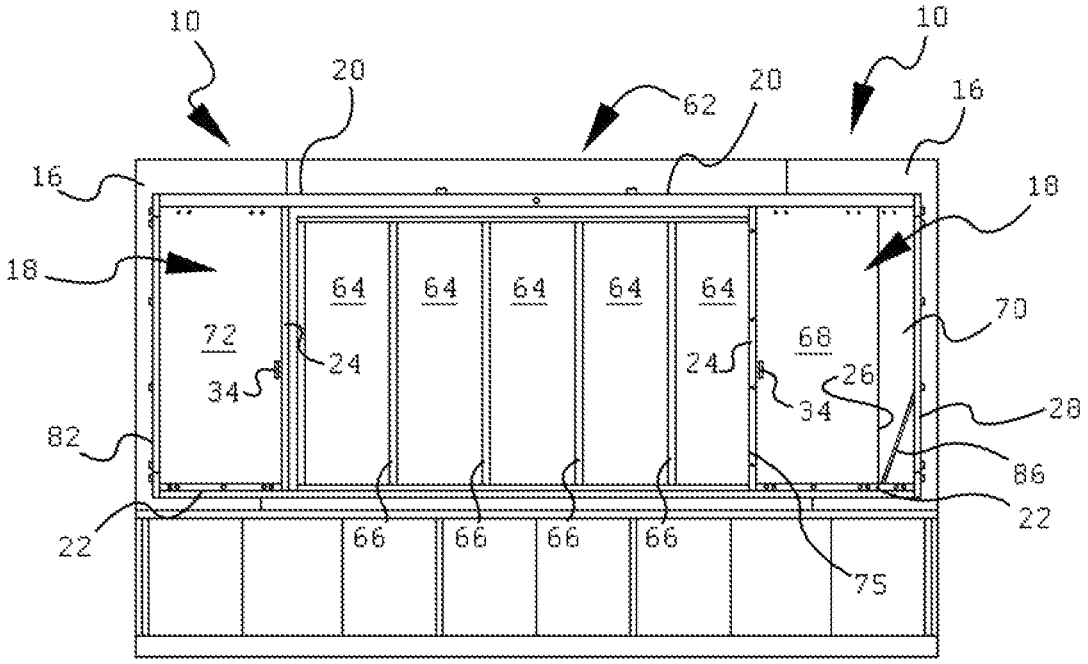

FIG. 8B shows the first ballistic barrier panel 68 moved to partially block the window opening 62 and a first locking bar 86 moving towards its locking position. Although the sequence of steps taken to block the window opening 62 are described in a particular order to facilitate understanding the invention, it should be understood that order that steps can be taken can differ with some steps being taken simultaneously if undertaken by more than one person. Such changes in the sequence of steps are contemplated by this disclosure.

The first locking bar 86 of FIG. 8B may be the same as has been described herein with respect to the doorway embodiment of the ballistic barrier 10, except that the free end 88 (not shown in FIG. 8B) is not slidably retained within the storage side channel 28. Otherwise, the first locking bar 86 may be painted or made of a material that is easily visible, such as optic orange, so it is obvious from visual observation that it is or is not properly positioned to lock the ballistic barrier 10. Also, the first locking bar 86 may have a pivotal connection (not visible in FIG. 8B, but similar to pivotal connection 52 depicted in FIG. 5) disposed at the lower portion of the first ballistic barrier panel 68 proximate its trailing edge 26 that enables to the locking bar 86 to fall, under the force of gravity, as the ballistic barrier panel 18 is moved slidably from its storage position towards the fully deployed position.

Figure 8C:
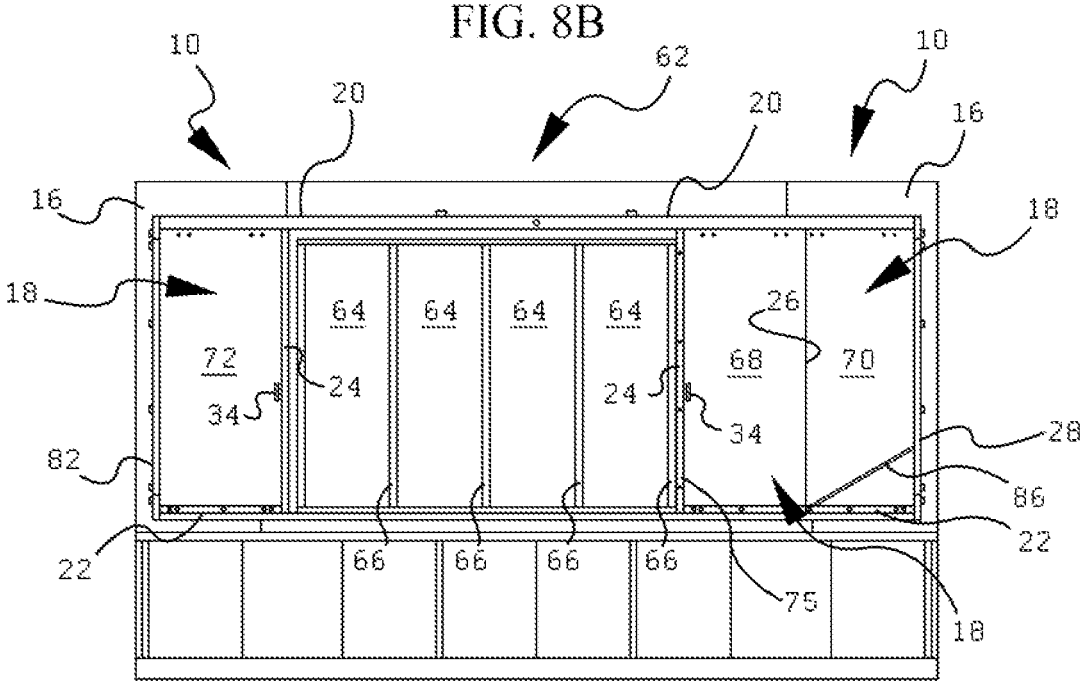
Figure 8D:
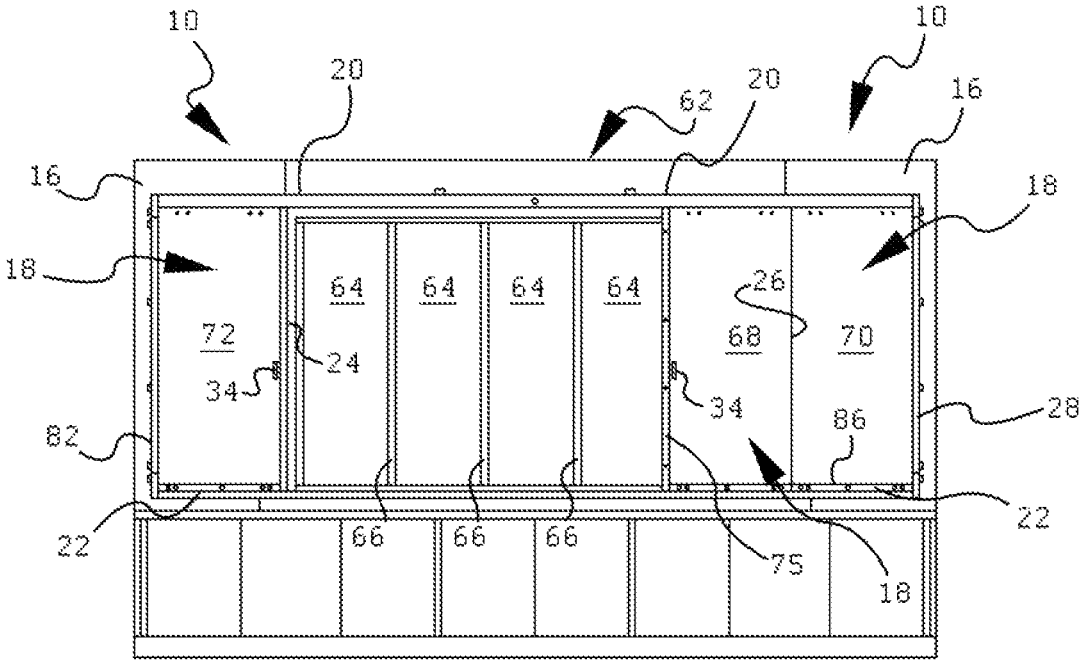

FIG. 8C shows the first ballistic barrier panel 68 overlapping the second ballistic barrier panel 70 and in position to capture the second ballistic barrier panel 70 for tandem movement and blocking more of the window opening 62. FIG. 8D shows the first ballistic barrier panel 68 overlapping and capturing the second ballistic barrier 70 for tandem movement to further block the window opening 62 and the first locking bar 86 resting substantially horizontal in the lower channel 22. The capturing of the second ballistic barrier 70 for tandem movement will be described in more detail with reference to FIG. 11 hereinafter.

Figure 8E:
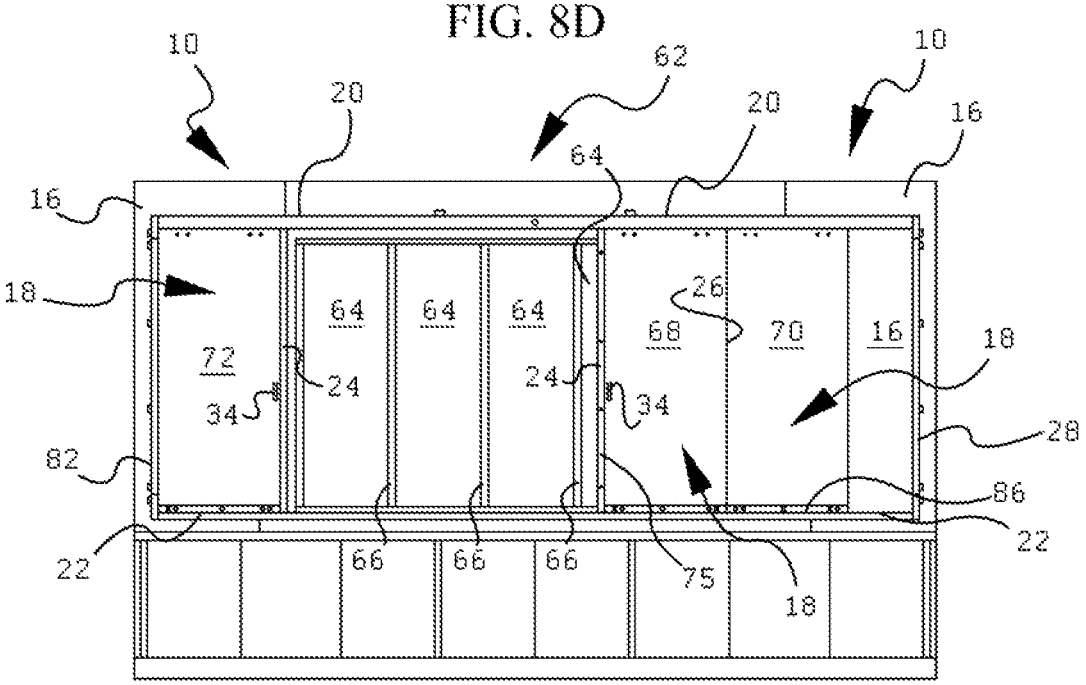
Figure 8F:
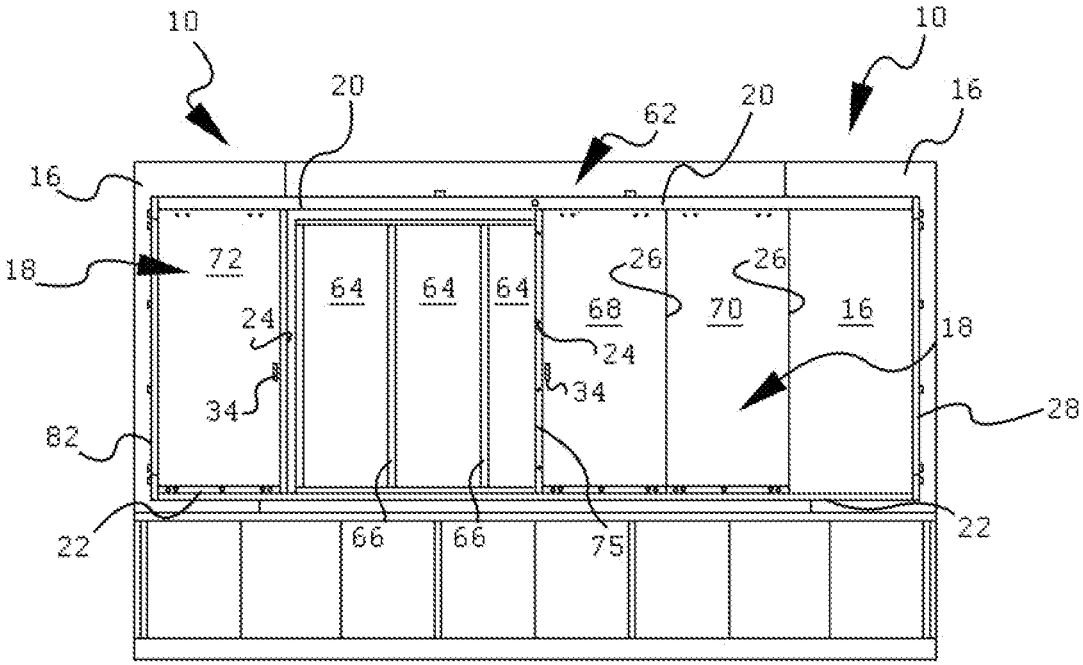

As shown in FIG. 8E, the first ballistic barrier panel 68 has been moved in tandem with the second ballistic barrier panel 70 to expose adjacent wall 16 behind the second ballistic barrier panel 70 and to further block the window opening 62, the first locking bar 86 trails the first ballistic barrier panel 68. FIG. 8F shows the first ballistic barrier panel 68 and the second ballistic barrier panel 70 fully extended to further block the window opening 62, the trailing first locking bar 86 is disposed in its locking position (as will be described with reference to FIGS. 9 and 10 hereinafter). As shown, the ballistic barrier 10 blocks approximately half of the window opening 62.

Figure 8G:
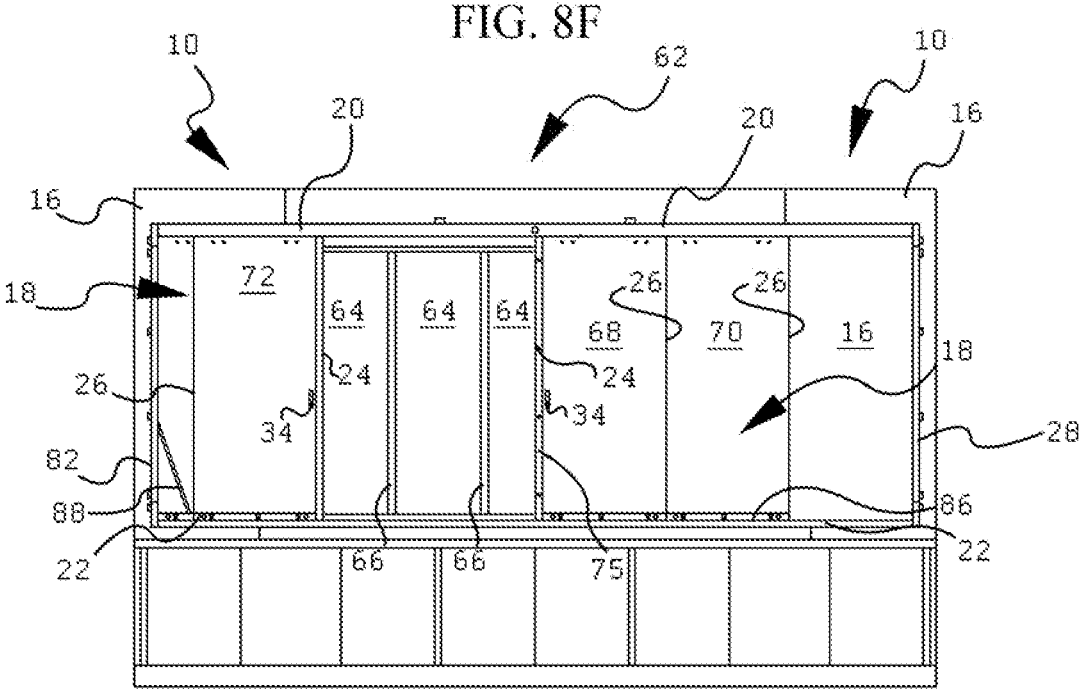
Figure 8H:
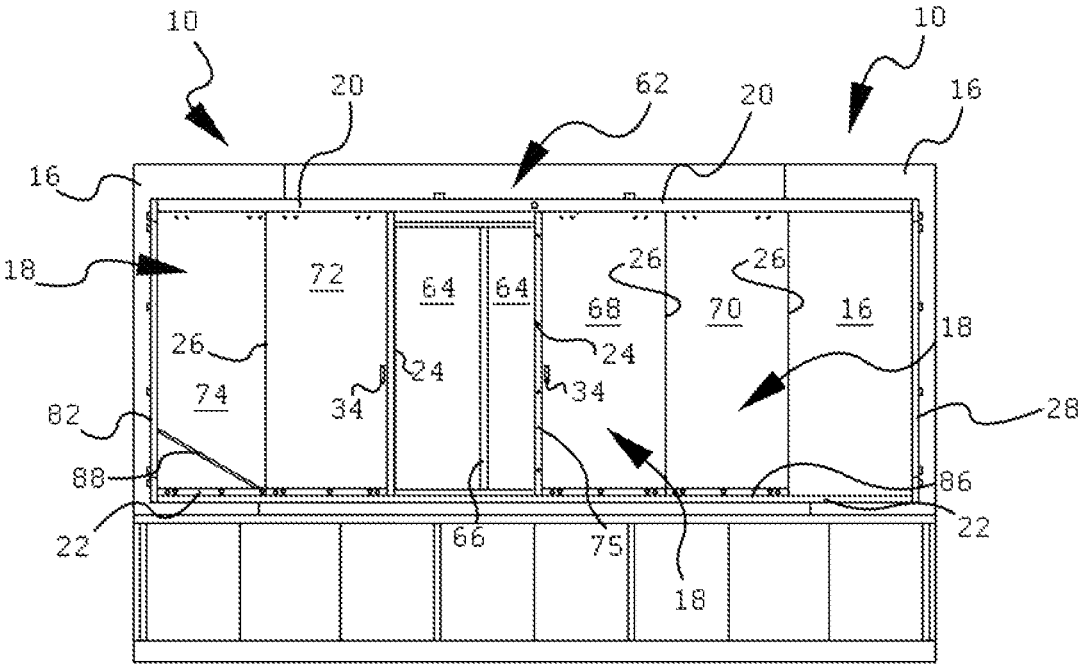
Figure 8I:
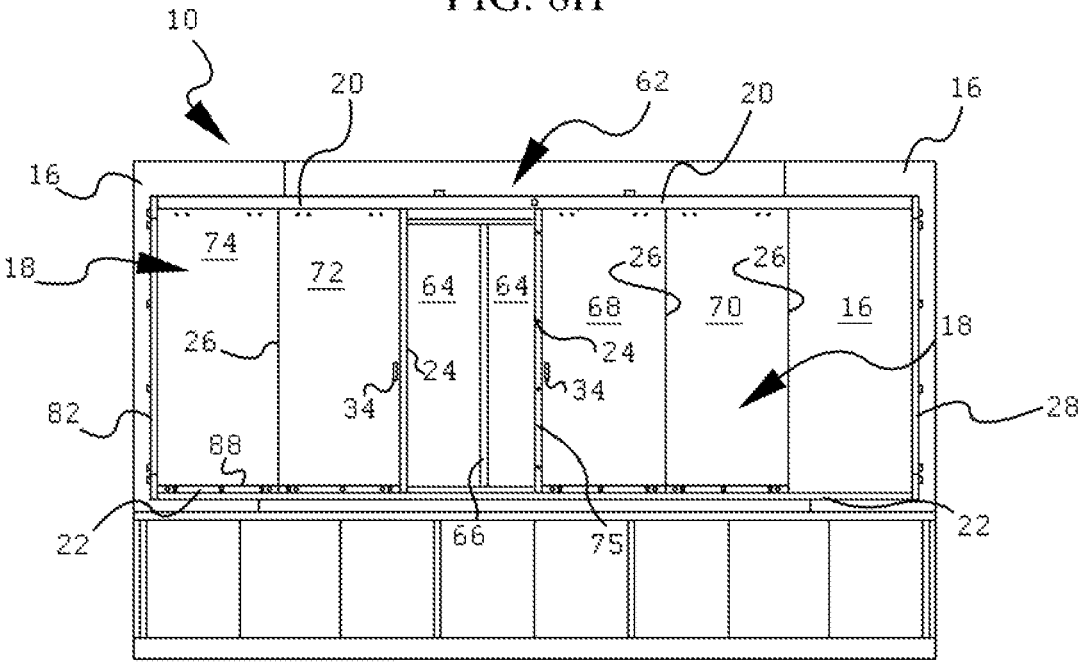

FIGS. 8G-8K follow a similar sequence as just described in FIGS. 8A-8F but are directed to the movement of the third and fourth ballistic barrier panels 72, 74. As shown in FIG. 8G, the third ballistic barrier panel 72 has been moved to partially block the window opening 62 revealing a second locking bar 88 moving towards its locking position. FIG. 8H shows the third ballistic barrier panel 72 overlapping the fourth ballistic barrier panel 74 and in position to capture the fourth ballistic barrier panel 74 for tandem movement and blocking more of the window opening 62. In FIG. 7I, the third ballistic barrier panel 72 is shown overlapping and capturing the fourth ballistic barrier panel 74 for tandem movement to further block the window opening 62, and the second locking bar 88 has dropped, under the force of gravity, to rest substantially horizontal in the lower channel 22.

Figure 8J:
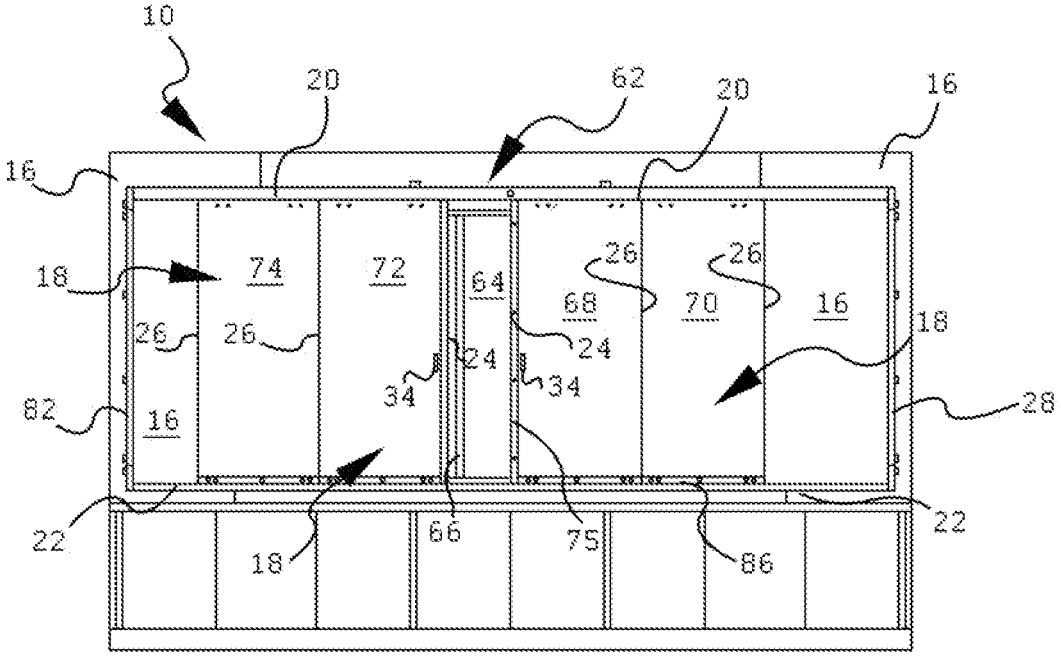
Figure 8K:
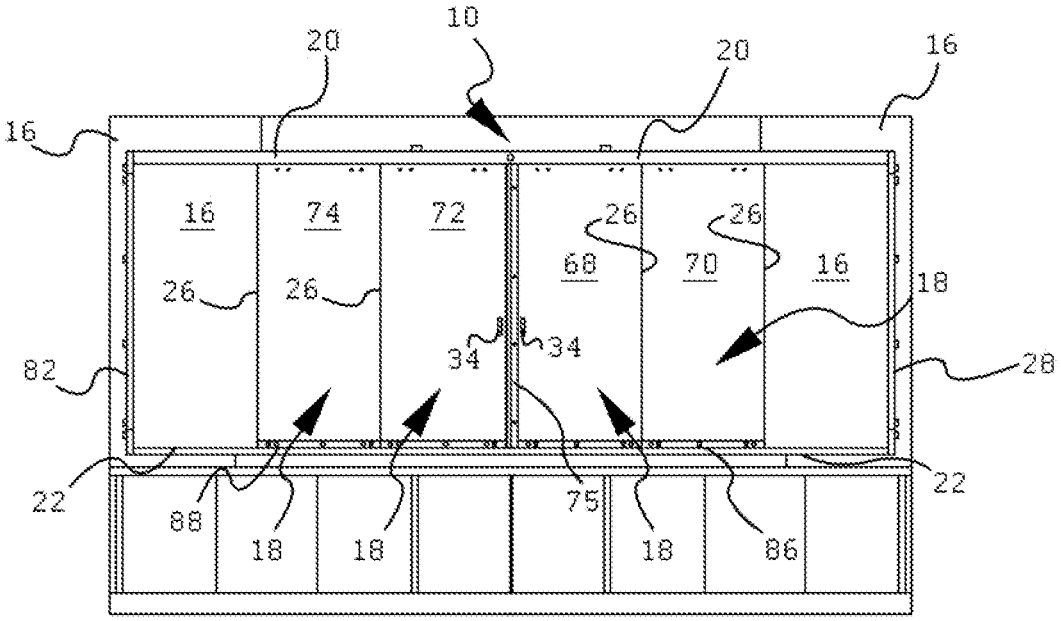

FIG. 8J shows the third ballistic barrier panel 72 moving the fourth ballistic barrier panel 74 to further block the window opening 74 while the second locking bar 88 trails the third ballistic barrier panel 72. In FIG. 8K, the third ballistic barrier panel 72 and the fourth ballistic barrier panel 74 are shown fully extended to fully block the window opening 62, the trailing second locking bar 88 is disposed in its locking position. As shown, the astragal 75 overlaps the leading edge 24 of the third ballistic barrier panel 72 to block the seam created by the abutting engagement of the leadings edges 24 of the first and third ballistic barrier panels 68, 72.

Figure 9:
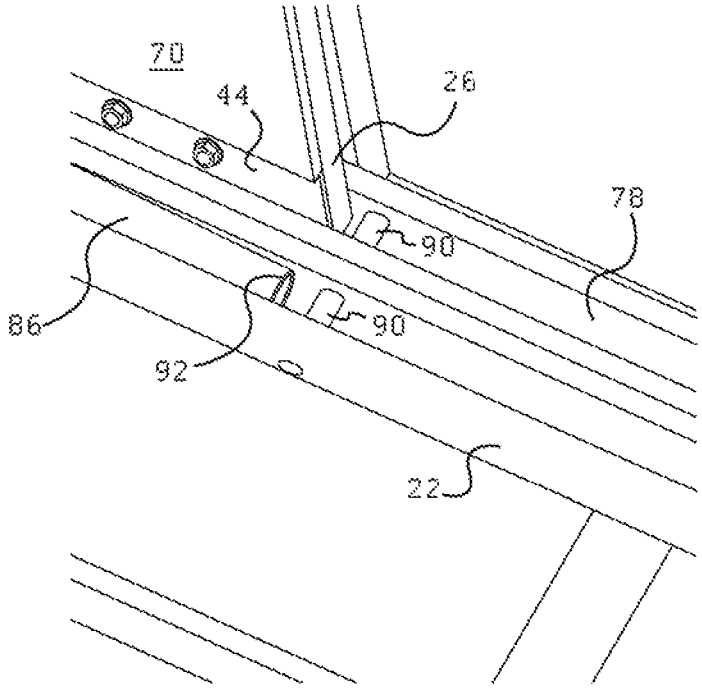
FIG. 9 is a perspective view of the first locking bar in its locking position to inhibit opening of the overlapping first and second ballistic barrier panels.
Figure 10:
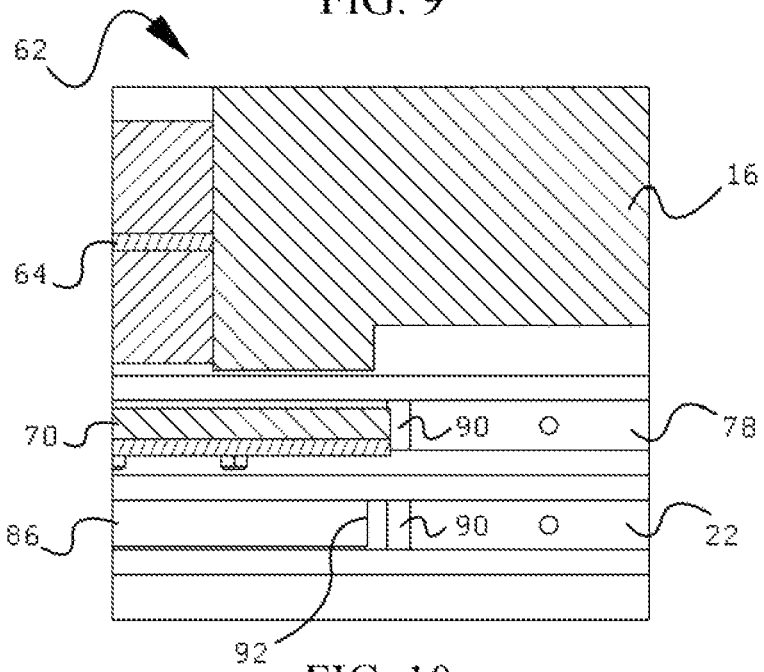
FIG. 10 is a section view along an elevated horizontal plane through the wall, window, and second ballistic barrier panel showing the first locking bar in its locking position to inhibit opening of the overlapping first and second ballistic barrier panels.

FIGS. 9 and 10 provide differing views of how the first locking bar 86 drops into it locking position when the first ballistic barrier panel 68 is fully extended to block the window opening 62. As shown, an abutment stop 90 extends across bottom channel 22 and may further extend across second bottom channel 78. The abutment stop 90 is disposed low enough in the bottom channel 22 and second bottom channel 78 so that the ballistic barrier panels 18 slid over the abutment stop 90 so to present little or no resistance to the sliding movement of the ballistic barrier panels 18, but high enough in the bottom channel 22 to provide a secure abutment against which the free end 92 of the first locking bar 86 abut firmly. Although FIGS. 9 and 10 show a gap between the free end 92 and the abutment stop 90, the gap is shown merely to facilitate the understanding of the abutment stop 90. In practice, the gap, if any, would be minimal or minute so that the ballistic barrier panels 18 cannot be wiggled by an assailant to create unwanted seams or openings in the ballistic barrier 10. It would be preferred that the free end 92 abut against the abutment stop 90. Of course, it should be understood that a similarly situated abutment stop 90 may be disposed within the lower channel 22 to engage the free end 92 of the second locking bar 88 and stop undesired retraction of the third ballistic barrier panel 72.

Figure 11:
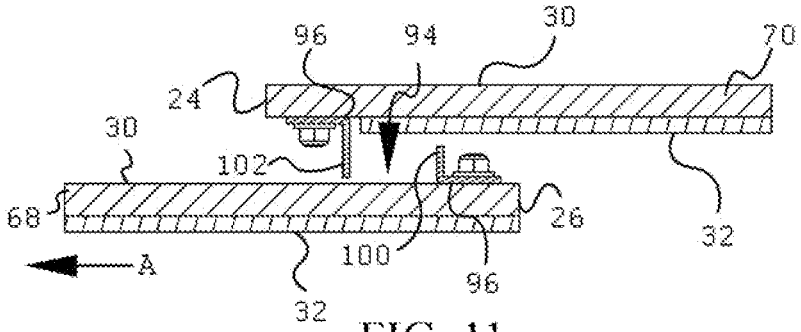
FIG. 11 is a horizontal section view of portions of the first and second ballistic barrier panels showing a capture assembly to enable tandem movement of the first and second ballistic barrier panels.

FIG. 11 shows an exemplary capture assembly 94 that enables tandem movement of the first and second ballistic barrier panels 68, 70. The capture assembly 94 comprises an engaging flange 96 secured to the second ballistic barrier panel 79 and a drag flange 98 secured to first ballistic barrier panel 68. So not to present and assailant with an opening at the overlapping interface of the first and second ballistic barriers 68, 70, the engaging flange 96 and drag flange 98 extend the full vertical height of the first and second ballistic barriers 68, 70, respectively. When the first ballistic barrier panel 68 is moved in the direction of Arrow A, the leading surface 100 of the drag flange 98 will engage and capture the engaging flange 96 so that the first and second ballistic barriers 68, 70, move in tandem thereafter.

Additionally, a ballistic material or end cap (not shown) may be secured to the leading surface 102 of the engaging flange 96 and/or the leading edge 24 of the second ballistic barrier panel 70 to present additional ballistic shielding at the overlapping interface of the first and second ballistic barriers 68, 70. Further, although FIG. 11 shows only an exemplary capture assembly 94, those skilled in the art would understand that many other types of capture assemblies may be made to accomplish the capture and tandem movement functions described above and contemplated by this disclosure.

Figure 12:
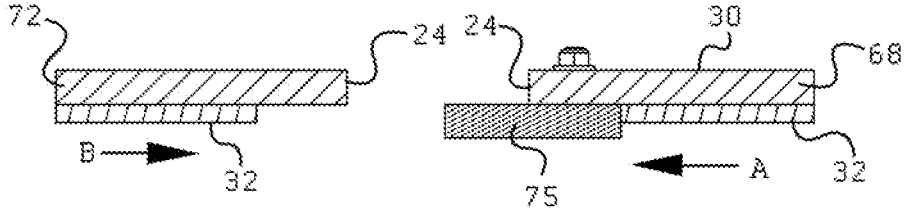
FIG. 12 is a horizontal section view of portions of the first and third ballistic barrier panels showing an astragal that provides ballistic protection across the seam when the first and third meet in abutting engagement.

FIG. 12 shows portions of the first and third ballistic barrier panels 68, 72 just before abutting engagement. To effect abutting engagement, the first ballistic barrier panel 68 is moved in the direction of Arrow A and the third ballistic barrier panel 72 is moved in the direction of Arrow B. When abutting engagement of the leading edges 24 of the first and third ballistic barrier panels 68, 72 is accomplished, the astragal 75 spans the abutment seam created and provides ballistic protection across the abutment seam.

Figure 13:
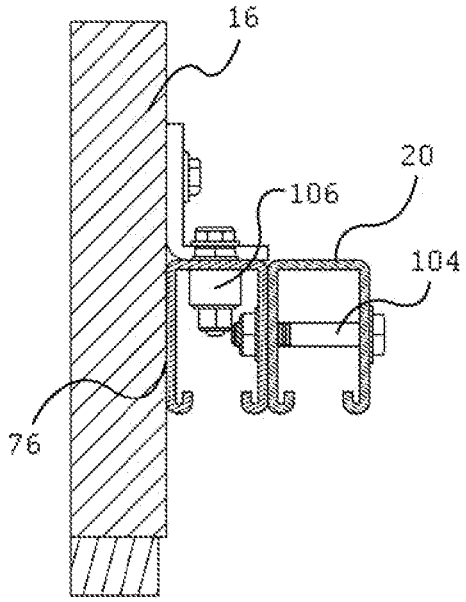
FIG. 13 is a vertical section view of a first upper channel and a second upper channel as attached to a wall and showing a first upper stop and a second upper stop that inhibit the first and second ballistic barrier panels from over-extending over the window opening.

FIG. 13 is a vertical section view of a upper channel 20 and a second upper channel 76 as attached to the adjacent wall 16 and showing a first upper stop 104 and a second upper stop 106 that inhibit the first and second ballistic barrier panels 68, 70 from over-extending over the window opening 62, and assure that the abutting engagement of the first and third ballistic barrier panels 68, 72 is as snug as possible.

Figure 14:
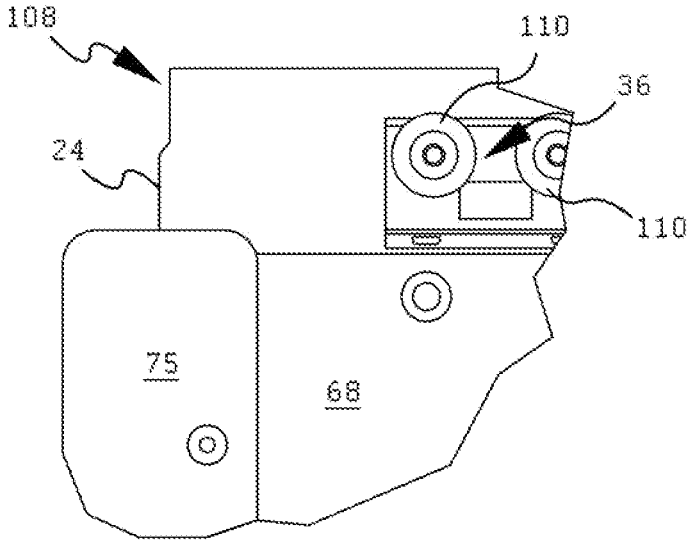
FIG. 14 is a cutaway elevation upper leading corner of the first ballistic barrier panel showing a stop clearance for engaging the first upper stop and a suspension roller.

FIG. 14 is a cutaway elevation of the upper leading corner of the first ballistic barrier panel 68 showing a stop clearance 108 for engaging the first upper stop 104 and the heavy-duty suspension rollers 36. The heavy-duty suspension rollers 36 are for suspending the ballistic barrier panels 18 for slidable movement of the ballistic barrier panels 18. The rollers 110 for each ballistic barrier panel 18 roll over the curled flange 50 of the upper channel 20 or the curled flange 50 of the second upper channel 76. The stop clearance 108 is at least as wide as the first upper stop 104 to assure as snug a fit as possible. Similarly, the upper leading corner of the second ballistic barrier panel 70 has a stop clearance 108 for engaging the second upper stop 106 and heavy-duty suspension rollers 36 for suspending the second ballistic barrier panel 70 for slidable movement 18. Again, the stop clearance 108 for the second ballistic barrier panel 70 is at least as wide as the second upper stop 106 to assure as snug a fit as possible.

Figure 15:
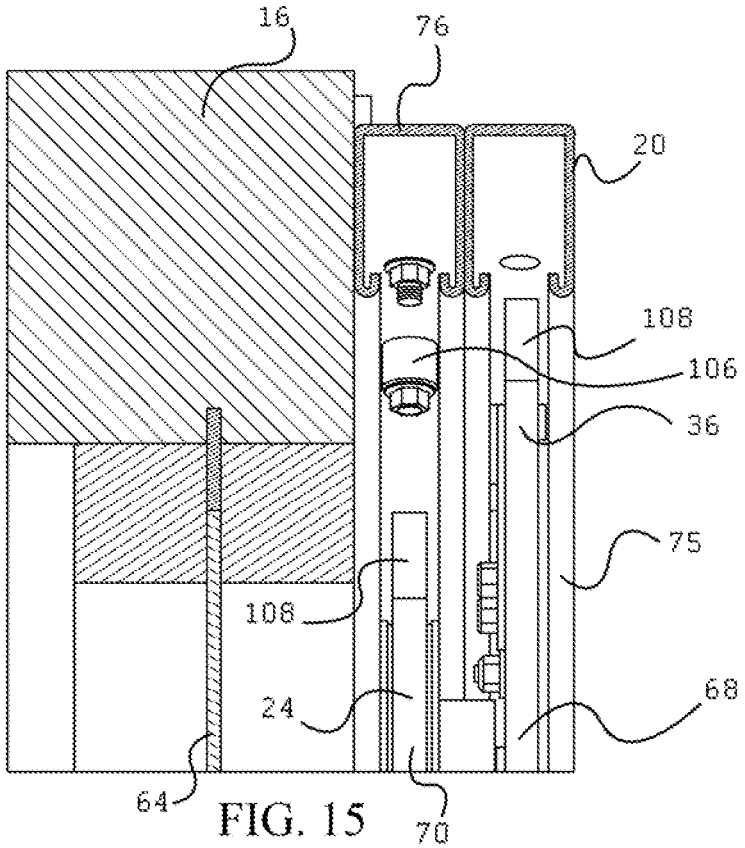
FIG. 15 is a perspective end-on view of the first and second ballistic barrier panels with the stop clearance of the second ballistic barrier panel approaching the second upper stop.

FIG. 15 is a perspective end-on view of the first and second ballistic barrier panels with the stop clearance 108 of the second ballistic barrier panel 70 approaching engagement with the second upper stop 106.

Figure 16:
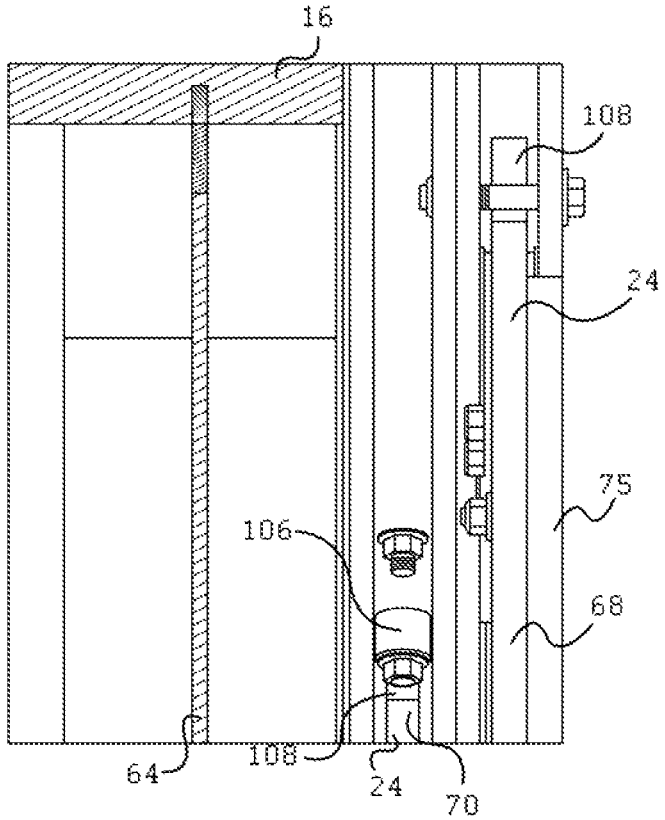
FIG. 16 is a perspective end-on view of the first and second ballistic barrier panels with the stop clearance of the second ballistic barrier panel engaging the second upper stop and the stop clearance of the first ballistic barrier panel engaging the first upper stop.

In FIG. 16, a perspective end-on view of the first and second ballistic barrier panels 68, 70 shows the stop clearances 108 of the second ballistic barrier panel 70 engaging the second upper stop 106 and the stop clearance 108 of the first ballistic barrier panel 68 engaging the first upper stop 104.

Figure 17:
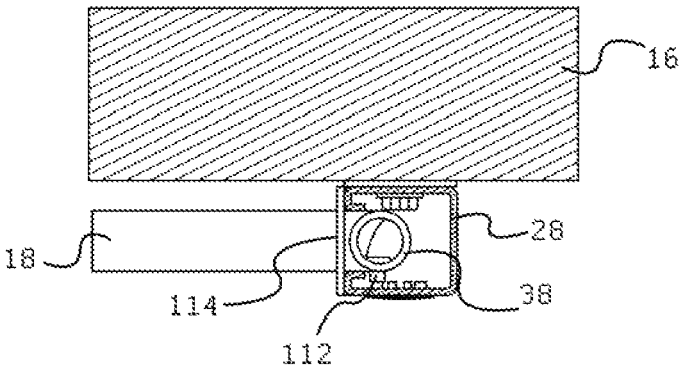
FIG. 17 is a horizontal section of the wall and the storage side channel showing the free end of the locking bar fully disposed substantially vertically and nested within the storage side channel.
Figure 18:
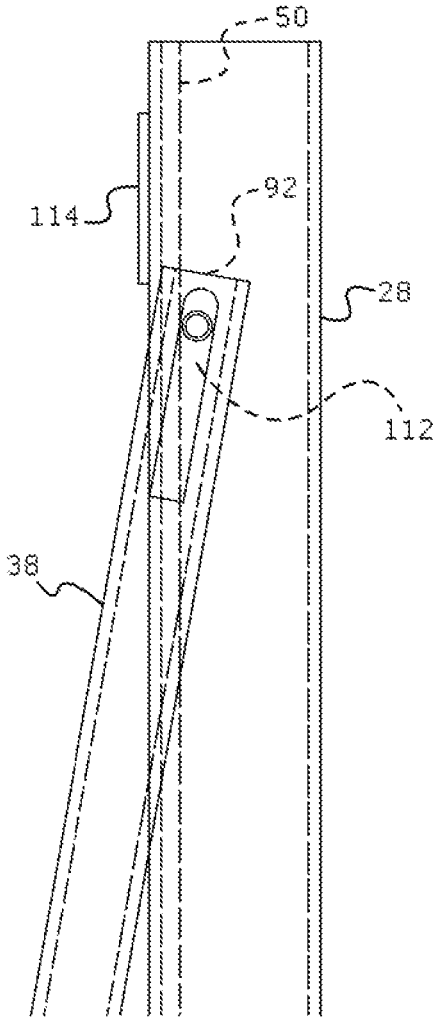
FIG. 18 is vertical cutaway elevation view of the storage side channel and the locking bar as it falls, under the force of gravity, while the free end is retained in slidable engagement within the storage side channel.

FIGS. 17 and 18 illustrate an alternative exemplary embodiment of the sliding engagement of the free end 92 of the locking bar 38 as may be used for a doorway or single-panel window opening embodiment of the ballistic barrier 10. FIG. 17 shows the free end 92 of the locking bar 38 fully disposed substantially vertically and nested within the storage side channel 28. To retain the free end 92 within the storage side channel 28 a spring-loaded detent button 112 and a retention flat 114 are provided. At initial installation, the spring-loaded detent button 112 may be depressed so that the free end 92 of the locking bar 38 may be inserted into the storage side channel 28 and tucked under the retention flat 114 as shown. The trailing edge 26 of the ballistic barrier panel 18 abuts against the retention flat 114 to obscure the locking bar 38 from view from inside the room 12.

FIG. 18 is vertical cutaway elevation view of the storage side channel 28 and the locking bar 38 as it begins to fall (because the ballistic barrier panel 18, not shown, has been moved slightly), under the force of gravity, while the free end 92 is retained in slidable engagement within the storage side channel 28. The phantom lines are provide to show inner surfaces of the storage side channel 28, the locking bar 38, and the spring-loaded detent button 112. The spring-loaded detent button 112 slides along the inner surface of the curled edge 50 of the storage side channel 28 and thereby retains the free end 92 within the storage side channel 28 as the ballistic barrier panel 18 (not shown) is moved towards full deployment.

In some embodiments, the ballistic barrier panel 18 may trigger an alarm system as it is closed to block a doorway 14 or window opening 62. This alarm system could sound an audible alarm similar to a fire alarm but different to notify teachers and students at other locations to close their ballistic barrier panels 18. This alarm system could also alert authorities and responders to the potential threat of an assailant. In some instances, the triggering of the alarm system may cause the remaining ballistic barriers 10 on campus to close automatically. With each of these embodiments, a person of skill in the art would know how to implement an alarm system, alert authorities, and/or automatically close ballistic barrier panels 18.

While specific embodiments and applications of the present invention have been illustrated and described, it is to be understood that the invention is not limited to the precise configuration and components disclosed herein. Various modifications, changes, and variations which will be apparent to those skilled in the art may be made in the arrangement, operation, and details of the methods and systems of the present invention disclosed herein without departing from the spirit and scope of the invention.

What is claimed is:

1. A barrier system for blocking a doorway against active shooter situations and for storage along an adjacent wall in ready position to be deployed to block the doorway, comprising:

a barrier panel;

an upper channel, a lower channel, side channel, and a storage side channel; the upper channel being disposed to extend over the doorway and along an adjacent wall to receive the barrier panel in nesting but slidable engagement; the lower channel being disposed along the adjacent wall and not extending into the doorway for receiving the barrier panel in nesting but slidable engagement, the side channel being disposed along a side of the doorway opposite from the adjacent wall for receiving the barrier panel in nesting engagement when the barrier panel is closed to block the doorway; and a locking bar that moves from a substantially vertical disposition adjacent the storage side channel into a substantially horizontal locking position as the barrier panel is drawn to close the doorway and positions into the locking position when the barrier panel nests in the side channel, upper channel, and lower channel simultaneously.

2. A barrier system as in claim 1, wherein the barrier panel is made of a ballistic material.

3. A barrier system as in claim 1, further comprising a retention plate that restricts vertical movement of the barrier panel within the upper channel and lower channel such that the nesting engagement of the barrier panel within the upper channel and lower channel is retained.

4. A barrier system as in claim 1, wherein the retention plate has a curled edge that interlocks with either of the upper channel and the lower channel.

* * * * *